US011242220B2

(12) United States Patent
Fonteneau

(10) Patent No.: US 11,242,220 B2
(45) Date of Patent: Feb. 8, 2022

(54) SAFETY BRAKING SYSTEMS FOR ELEVATORS

(71) Applicant: Otis Elevator Company, Farmington, CT (US)

(72) Inventor: Nicolas Fonteneau, Chateauneuf sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 814 days.

(21) Appl. No.: 16/134,024

(22) Filed: Sep. 18, 2018

(65) Prior Publication Data

US 2019/0084797 A1 Mar. 21, 2019

(30) Foreign Application Priority Data

Sep. 20, 2017 (EP) ..... 17306219

(51) Int. Cl.
*B66B 5/00* (2006.01)
*B66B 5/16* (2006.01)
(Continued)

(52) U.S. Cl.
CPC ..... *B66B 5/0025* (2013.01); *B66B 3/002* (2013.01); *B66B 5/0031* (2013.01);
(Continued)

(58) Field of Classification Search
CPC ..... B66B 5/0031; B66B 1/32; B66B 5/18; B66B 5/04; B66B 5/0018; B66B 5/02;
(Continued)

(56) References Cited

U.S. PATENT DOCUMENTS 5,255,760 A 10/1993 Lamb et al.
6,173,813 B1 * 1/2001 Rebillard ..... B66B 5/06 187/287

(Continued)

FOREIGN PATENT DOCUMENTS

CN 1068853 C 7/2001
CN 101287670 A 10/2008

(Continued)

OTHER PUBLICATIONS

Third Party Observation Submission, European Application No. 17306219.1, Date of Mailing Dec. 18, 2020, European Patent Office; 10 pages.

(Continued)

*Primary Examiner* — Marlon T Fletcher
(74) *Attorney, Agent, or Firm* — Cantor Colburn LLP

(57) ABSTRACT

Elevator safety brake and/or safety actuator health monitoring systems and methods including an elevator car moveable within an elevator shaft along a guide rail, and a first safety brake assembly arranged on the elevator car and configured to engage with the guide rail to provide emergency braking to the elevator car. The first brake assembly includes a first safety brake and an electronic safety actuator operably connected to the first safety brake. A health monitoring element is in communication with the electronic safety actuator. The health monitoring element is configured to record information associated with operation of the first safety brake assembly, compare the recorded information against at least one predetermined threshold, and when the recorded information exceeds the at least one predetermined threshold, generate a notification that maintenance is required.

18 Claims, 5 Drawing Sheets

(51) Int. Cl.
*B66B 3/00* (2006.01)
*B66B 5/18* (2006.01)
*B66B 5/22* (2006.01)

(52) U.S. Cl.
CPC ..... *B66B 5/0093* (2013.01); *B66B 5/16* (2013.01); *B66B 5/18* (2013.01); *B66B 5/22* (2013.01)

(58) Field of Classification Search
CPC ..... B66B 1/36; B66B 5/0025; B66B 5/16; B66B 5/044; B66B 5/0087; B66B 5/0006; B66B 25/006
See application file for complete search history.

(56) References Cited

U.S. PATENT DOCUMENTS

| | | | | |
|---|---|---|---|---|
| 7,047,797 | B2 | 5/2006 | Giessler | |
| 7,577,517 | B2 | 8/2009 | Nagasawa | |
| 9,580,276 | B2 | 2/2017 | Toutaoui | |
| 9,604,818 | B2 | 3/2017 | Kallioniemi et al. | |
| 9,714,155 | B2 | 7/2017 | Tyni et al. | |
| 10,654,683 | B2 * | 5/2020 | Dominguez | B66B 1/44 |
| 2007/0051563 | A1 * | 3/2007 | Oh | B66B 5/22 187/371 |
| 2008/0060883 | A1 | 3/2008 | Tyni et al. | |
| 2008/0067011 | A1 | 3/2008 | Gremaud et al. | |
| 2012/0000729 | A1 * | 1/2012 | Marvin | B66B 5/044 187/287 |
| 2012/0000731 | A1 * | 1/2012 | Schienda | B66B 5/06 187/305 |
| 2012/0000732 | A1 * | 1/2012 | Draper | B66B 5/06 187/373 |
| 2014/0311257 | A1 * | 10/2014 | Hubbard | B66B 5/0037 73/862.12 |
| 2015/0284214 | A1 | 10/2015 | Park et al. | |
| 2015/0293799 | A1 | 10/2015 | Sekine et al. | |
| 2016/0052747 | A1 | 2/2016 | Toutaoui | |
| 2019/0055107 | A1 * | 2/2019 | Michel | B66B 19/00 |
| 2019/0084797 | A1 * | 3/2019 | Fonteneau | B66B 5/0025 |
| 2019/0177114 | A1 * | 6/2019 | Fargo | B66B 5/0031 |
| 2019/0300331 | A1 * | 10/2019 | Sudi | B66B 1/32 |
| 2019/0382237 | A1 * | 12/2019 | Witczak | B66B 3/002 |
| 2020/0002122 | A1 * | 1/2020 | Koskinen | F16H 15/20 |
| 2020/0048040 | A1 * | 2/2020 | Fauconnet | B66B 5/18 |
| 2020/0048041 | A1 * | 2/2020 | Fauconnet | B66B 5/18 |
| 2020/0115189 | A1 * | 4/2020 | Dube | F16D 63/002 |
| 2020/0180908 | A1 * | 6/2020 | Chao | B66B 5/16 |
| 2020/0391976 | A1 * | 12/2020 | Viljanen | B66B 1/3407 |
| 2021/0139278 | A1 * | 5/2021 | Onat | B66B 5/04 |
| 2021/0155447 | A1 * | 5/2021 | Munoz Sotoca | B66B 5/18 |

FOREIGN PATENT DOCUMENTS

| | | | |
|---|---|---|---|
| CN | 101092223 | B | 3/2011 |
| CN | 103209918 | A | 7/2013 |
| CN | 103663075 | A | 3/2014 |
| CN | 104891290 | A | 9/2015 |
| CN | 105217389 | | 1/2016 |
| CN | 205061233 | U | 3/2016 |
| CN | 107000962 | A | 8/2017 |
| EP | 1127025 | B1 | 8/2001 |
| EP | 2773584 | A1 | 9/2014 |
| EP | 2791039 | | 10/2014 |
| EP | 2807103 | A1 | 12/2014 |
| EP | 2930134 | A1 | 10/2015 |
| EP | 2976281 | A1 | 1/2016 |
| EP | 3106417 | A1 | 12/2016 |
| EP | 3129314 | A1 | 2/2017 |
| JP | H092752 | | 1/1997 |
| JP | 2003238043 | | 8/2003 |
| JP | 2003327366 | | 11/2003 |
| WO | 2013066321 | A1 | 5/2013 |
| WO | 2013110693 | A1 | 8/2013 |
| WO | 2016091309 | | 6/2016 |
| WO | 2017001884 | A1 | 1/2017 |

OTHER PUBLICATIONS

China Office Action for China Application No. 201811094347.1; Application Filing Date: Sep. 19, 2018; dated May 13, 2021; Date of Receipt: Jun. 16, 2021, 16 pages.
European Search Report, European Application No. 17306219.1, dated Feb. 13, 2018, European Patent Office; European Search Report 9 pages.

* cited by examiner

SAFETY BRAKING SYSTEMS FOR ELEVATORS

CROSS REFERENCE TO RELATED APPLICATIONS

This application claims the benefit of European Application No. 17306219.1, filed Sep. 20, 2017, which is incorporated herein by reference in its entirety.

BACKGROUND

The embodiments herein relate to elevator braking systems and, more particularly, to systems and methods for safety braking systems for elevators and health monitoring thereof.

Elevator braking systems may include a safety braking system configured to assist in braking a hoisted structure (e.g., an elevator car) relative to a guide member, such as a guide rail. The safety braking systems can be arranged to stop movement of the elevator car in response to predetermined events, such as exceeding a predetermined speed or acceleration. Some braking systems include an electronic safety actuation device to actuate one or more safeties. Safeties and the electronic actuators require periodic inspection and maintenance to ensure proper operation of the safety braking systems. Such inspection and maintenance is typically performed on site manually by a technician.

BRIEF SUMMARY

According to some embodiments, elevator safety brake and/or safety actuator health monitoring systems are provided. The health monitoring systems include an elevator car moveable within an elevator shaft along a guide rail, and a first safety brake assembly arranged on the elevator car and configured to engage with the guide rail to provide emergency braking to the elevator car. The first brake assembly includes a first safety brake and an electronic safety actuator operably connected to the first safety brake. A health monitoring element is in communication with the electronic safety actuator. The health monitoring element is configured to record information associated with operation of the first safety brake assembly, compare the recorded information against at least one predetermined threshold, and, when the recorded information exceeds the at least one predetermined threshold, generate a notification that maintenance is required.

In addition to one or more of the features described herein, or as an alternative, further embodiments of the health monitoring systems may include a second safety brake assembly, the health monitoring element being in communication with the second safety brake assembly, wherein the health monitoring element is configured to record information associated with operation of the second safety brake assembly.

In addition to one or more of the features described herein, or as an alternative, further embodiments of the health monitoring systems may include that the information associated with the first safety brake assembly comprises at least one of a number of times the first safety brake engages with the guide rail, an amount of time the first safety brake engages with the guide rail, an amount of time of activation of the electronic safety actuator, and a distance traveled by the first safety brake when engaged with the guide rail.

In addition to one or more of the features described herein, or as an alternative, further embodiments of the health monitoring systems may include a position reference system configured to detect at least one of a position of the elevator car within the elevator shaft and an amount of travel distance of the elevator car within the elevator shaft.

In addition to one or more of the features described herein, or as an alternative, further embodiments of the health monitoring systems may include that the first safety brake of the first safety brake assembly comprises one or more mechanical brake elements arranged to engage with the guide rail.

In addition to one or more of the features described herein, or as an alternative, further embodiments of the health monitoring systems may include that the electronic safety actuator comprises an electronic brake element arranged to activate the first safety brake.

In addition to one or more of the features described herein, or as an alternative, further embodiments of the health monitoring systems may include that the health monitoring element is an integral component of an elevator controller.

In addition to one or more of the features described herein, or as an alternative, further embodiments of the health monitoring systems may include that the health monitoring element is a component mounted to an exterior of the elevator car.

In addition to one or more of the features described herein, or as an alternative, further embodiments of the health monitoring systems may include that the health monitoring element is an integral component of the electronic safety actuator.

In addition to one or more of the features described herein, or as an alternative, further embodiments of the health monitoring systems may include that the notification is at least one of an alert, an alarm, and a transmitted message.

According to some embodiments, methods of monitoring a health of safety brake and/or safety actuator assemblies of elevator systems are provided. The methods include receiving information from an electronic safety actuator of a safety brake assembly of the elevator system at a health monitoring element, comparing, using the health monitoring element, the received information against at least one preset threshold, and, when the received information exceeds the at least one preset threshold, generating a notification that maintenance is required to be performed on the safety brake assembly.

In addition to one or more of the features described herein, or as an alternative, further embodiments of the methods may include summing the received information to generate recorded data, wherein the recorded data is compared against the at least one preset threshold.

In addition to one or more of the features described herein, or as an alternative, further embodiments of the methods may include that the notification is at least one of an alert, an alarm, and a transmitted message.

In addition to one or more of the features described herein, or as an alternative, further embodiments of the methods may include receiving at least one of position and travel information at the health monitoring element from a position reference system.

In addition to one or more of the features described herein, or as an alternative, further embodiments of the methods may include that the information associated with the safety brake assembly comprises at least one of a number of times the safety brake assembly engages with a guide rail, an amount of time the safety brake assembly engages with the guide rail, an amount of time of activation of the electronic safety actuator, and a distance traveled by the safety brake assembly when engaged with the guide rail.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
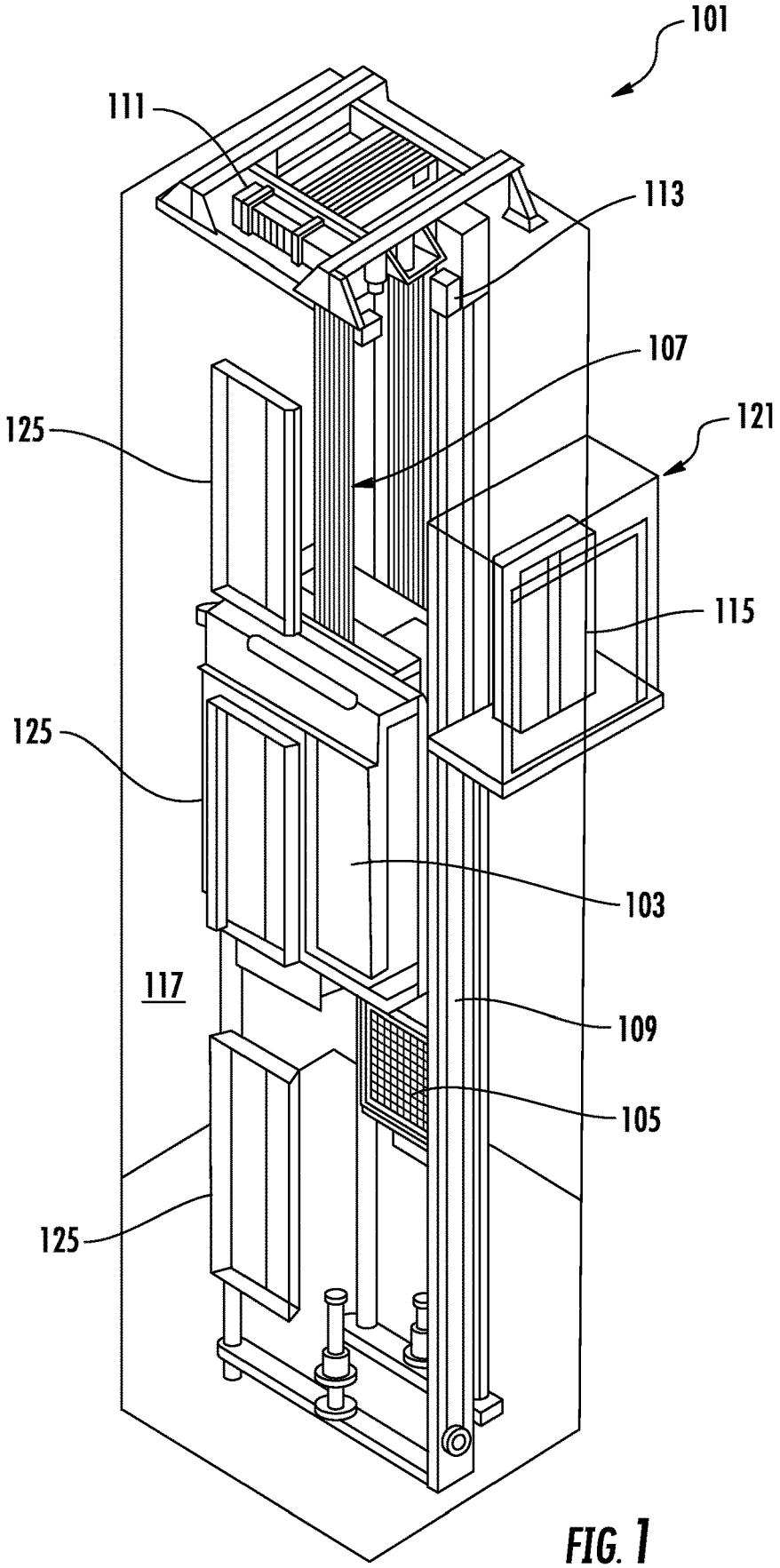
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc. as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
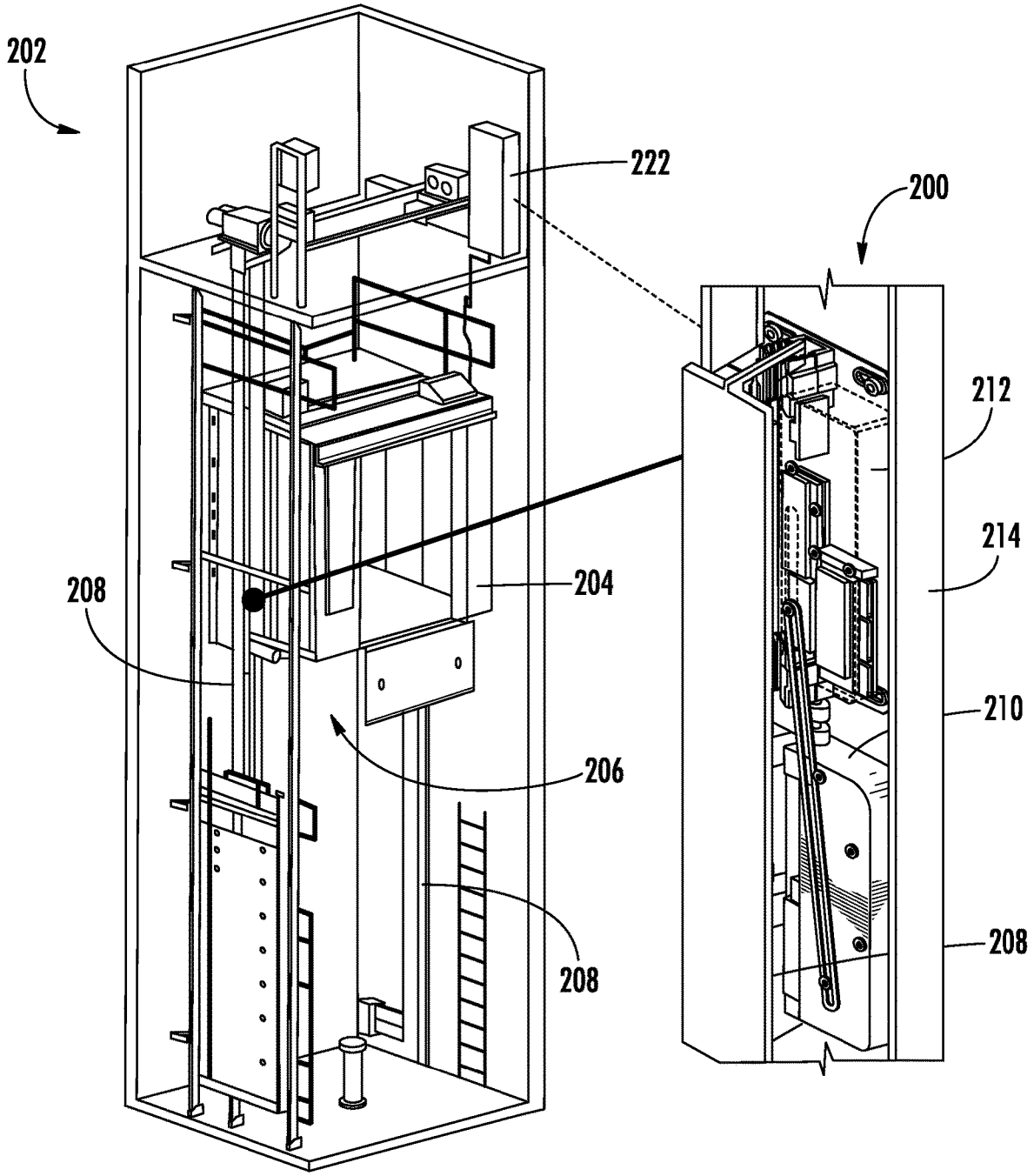
FIG. 2A is a schematic view of an elevator system having a safety brake assembly installed therewith.
Figure 2B:
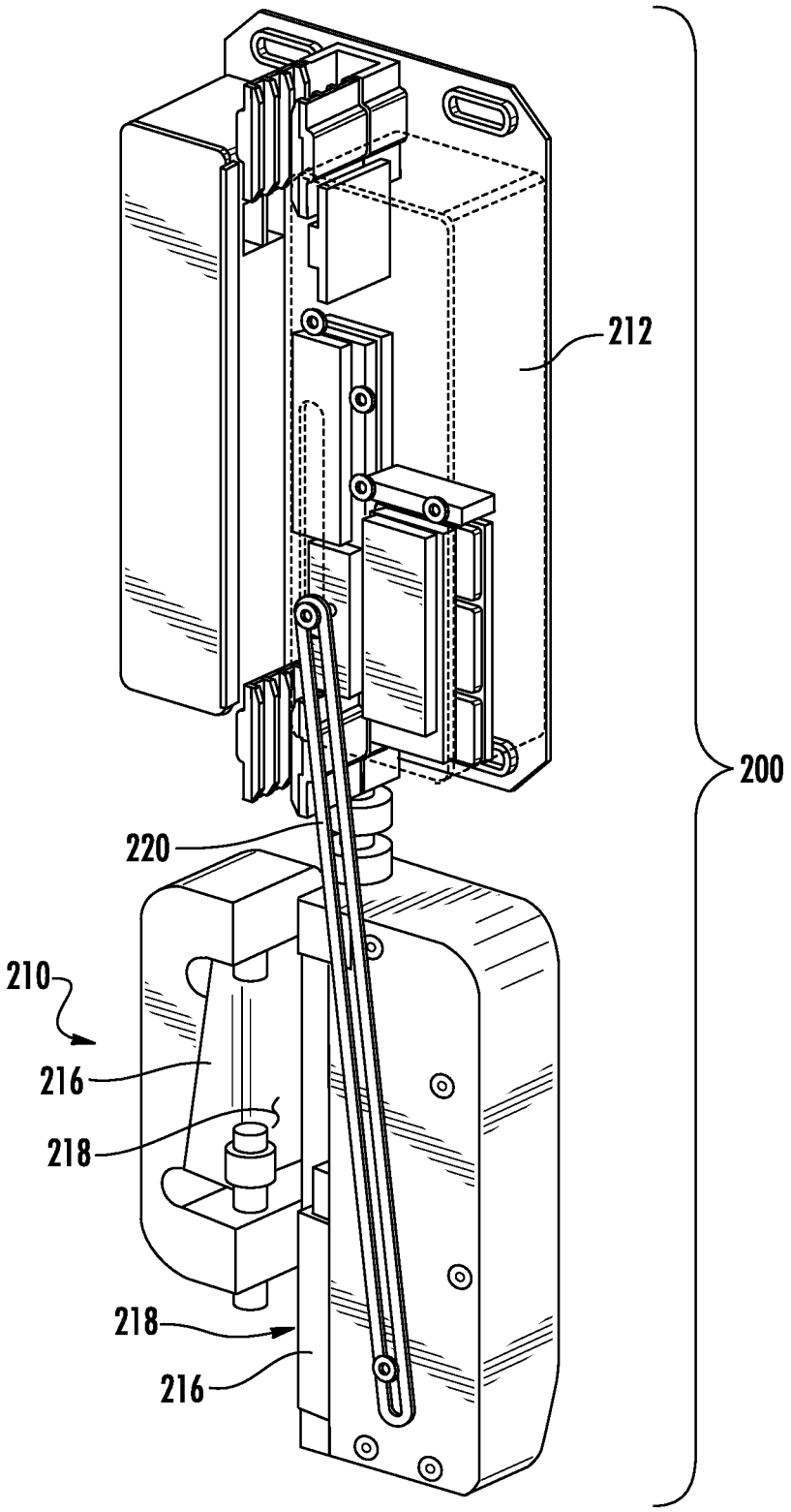
FIG. 2B is a schematic illustration of the safety brake assembly of FIG. 2A composed of a safety brake and safety actuator.

Turning now to FIGS. 2A-2B, schematic illustrations of a safety brake assembly 200 installed in an elevator system 202 are shown. The elevator system 202 includes an elevator car 204 that travels along or within an elevator shaft 206. The elevator car 204 is movable along and guided by one or more guide rails 208 connected to a sidewall of the elevator shaft 206. The embodiments described herein relate to an overall braking system that is operable to assist in braking (e.g., slowing or stopping movement) of the elevator car 204. In one embodiment, the braking is performed relative to the guide rail 208. Although a specific elevator system 202 is shown and described, brake assemblies as described herein can be used with various types of elevator systems.

The safety brake assembly 200 includes a safety brake 210 and an electronic safety actuator 212 that are operatively coupled to the elevator car 204. In some embodiments, the safety brake 210 and the electronic safety actuator 212 are mounted to a car frame 214 of the elevator car 204. The safety brake 210 includes a brake member 216, such as a brake pad or a similar structure suitable for repeatable braking engagement with the guide rail 208. As shown, the brake member 216 has a contact surface 218 that is operable to frictionally engage the guide rail 208. The brake member 216 can be arranged in various different arrangements, including, but not limited to, wedge-brake configurations, magnetic-brake configurations, etc., as will be appreciated by those of skill in the art. In one non-limiting embodiment, the safety brake 210 and the electronic safety actuator 212 are combined into a single unit. In some embodiments, the electronic safety actuator 212 can include one or more electronic brake elements and/or activation magnets, with the electronic brake elements and/or activation magnets operably connected to a link member 220 to trigger activation of the brake member 216 (e.g., mechanical brake element).

The safety brake 210 is operable between a non-braking position and a braking position. The non-braking position is a position that the safety brake 210 is disposed in during normal operation of the elevator car 204. In particular, the contact surface 218 of the brake member 216 is not in contact with, or is in minimal contact with, the guide rail 208 while in the non-braking position, and thus does not frictionally engage the guide rail 208. In the braking position, the frictional force between the contact surface 218 of the brake member 216 and the guide rail 208 is sufficient to stop movement of the elevator car 204 relative to the guide rail 208. Various triggering mechanisms or components may be employed to actuate the safety brake 210 and thereby move the contact surface 218 of the brake member 216 into frictional engagement with the guide rail 208. In the illustrated embodiment, the link member 220 is provided and operably couples the electronic safety actuator 212 and the safety brake 210. In operation, movement of the link member 220 triggers movement of the brake member 216 of the safety brake 210 from the non-braking position to the braking position, thus enabling emergency stopping of the elevator car 204.

In operation, an electronic sensing device and/or a controller 222 is configured to monitor various parameters and conditions of the elevator car 204 and to compare the monitored parameters and conditions to at least one predetermined condition. In some embodiments, the predetermined condition(s) include(s) speed and/or acceleration of the elevator car 204, counts for activation or operation of the safety brake assembly 200, etc. In one non-limiting example, in the event that a monitored condition such as over-speed, over-acceleration, etc., meets a predetermined condition, the electronic safety actuator 212 is actuated to facilitate engagement of the safety brake 210 and the guide rail 208. At the same time, a counter may be increased to indicate an actuation or operation of the safety brake assembly 200. In some embodiments, the controller 222 and/or the electronic safety actuator 212 can be arranged to collect triggering counts, position reference information, running distances, etc. In some embodiments, an on-board computing system of the electronic safety actuator 212 may be configured to record/integrate/sum the travel performed by the brake member 216 on the guide rail 208 (e.g., engaged contact travel distances), the number/count of triggering/activation of the safety brake assembly 200, etc. The electronic safety actuator 212 (or the controller 222) can be configured to record and compare the recorded data against predetermined thresholds to monitor a health status of the safety brake assembly 200. The predetermined thresholds can be predefined and programmed into the electronic safety actuator 212 and/or controller 222. The thresholds can be obtained through testing, empiric reliability data from prior systems, etc.

In some embodiments, the electronic safety actuator 212 has a velocity sensor and an accelerometer. Data is analyzed by the controller 222 and/or the electronic safety actuator 212 of the safety brake assembly 200 to determine if there is an over-speed or over-acceleration condition and to track or record operation of the safety brake assembly 200. If an over-speed/over-acceleration condition is detected, the electronic safety actuator 212 activates, thereby pulling up on the link member 220 and driving the contact surface 218 of the brake member 216 into frictional engagement with the guide rail 208, thus applying a braking force to stop the elevator car 204. In some embodiments, the electronic safety actuator 212 can transmit measured and/or recorded data to the elevator controller 222 and the controller 222 can respond by transmitting an activation command back to the electronic safety actuator 212 to activate the safety brake assembly 200 in response to detected events.

In a non-limiting embodiment, an elevator system 202 can be arranged with two safety brake assemblies 200, with one on each guide rail 208. Each of the safety brake assemblies 200 can be independently operated/controlled by the respective onboard electronic safety actuator 212 or, in some embodiments, the two brake assemblies can be operably connected to a controller on the elevator car 204 and/or the controller 222, with such controller initiating activation of the electronic safety actuators 212 of the two safety brake assemblies 200 for synchronization purposes. In further embodiments, as noted, each electronic safety actuator 212 (and safety brake assembly 200) is configured to operate and/or activate independently from the other, when a predetermined event is detected. Still further, one electronic safety actuator 212 may be "smart" and another is "dumb," where the "smart" electronic safety actuator 212 monitors the operational data of the safety brake assembly 200 and, in the event of activation, the electronic safety actuator 212 transmits a command to the "dumb" safety brake assembly 200 to activate along with the "smart" safety brake assembly 200.

Embodiments described herein utilize the electronic safety actuator 212 to enable onboard (or "self") health monitoring of the safety brake assembly 200. The electronic safety actuator 212 includes processing components, electronic storage components, sensing components, etc. as will be appreciated by those of skill in the art (herein after referred to as "onboard electronics"). The onboard electronics are used to monitor the health of the safety brake assembly 200 during operation and in situ and in real-time. Thus, regularly scheduled inspection and maintenance can be reduced or eliminated, with notifications being generated when maintenance should be performed on the safety brake system 200.

Figure 3:
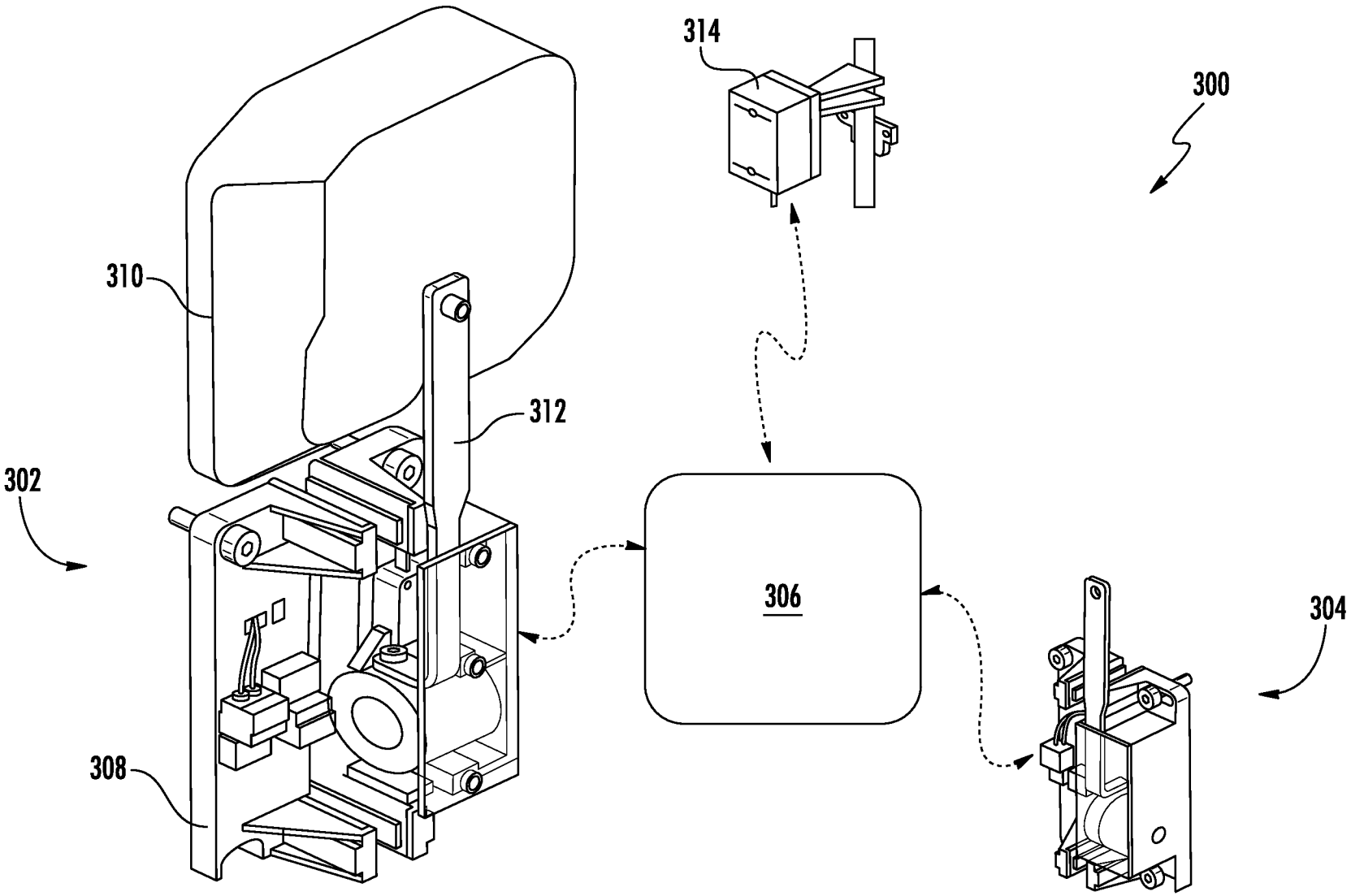
FIG. 3 is a schematic illustration of a safety brake and safety actuator health monitoring system in accordance with an embodiment of the present disclosure.

Turning now to FIG. 3, a schematic illustration of a safety brake health monitoring system 300 is shown. The safety brake health monitoring system 300 is a system that monitors the health of safety brakes, as shown and described above, to monitor for wear and life-ending events using onboard components. As shown, the safety brake health monitoring system 300 includes a first safety brake assembly 302, a second safety brake assembly 304, and a health monitoring element 306. In some embodiments, the health monitoring element 306 can be located on a portion of an elevator car and operably connected to and/or in communication with the first and/or second brake assemblies 302, 304. In some embodiments, the health monitoring element 306 can be integrated into an electronic safety actuator 308 of one of the brake assemblies 302, 304. In this illustrative embodiment, only the first safety brake assembly 302 is shown with operable connection between the electronic safety actuator 308 and a safety brake 310 by means of a link 312. However, those of skill in the art will appreciate that the second safety brake assembly 304 may be substantially similar to the first safety brake assembly 302.

The health monitoring element 306 is a computing system having one or more processors, control units, memory, and/or other electronic components that enable operation as described herein. For example, the health monitoring element 306 can include various communication devices/components to enable communication and/or operable connection to one or more other components of the safety brake health monitoring system 300 and/or an elevator system in which the safety brake health monitoring system 300 is implemented (e.g., communication with an elevator controller and/or elements of an elevator machine).

As shown, the safety brake health monitoring system 300 also includes a position reference system 314. The position reference system 314 can be any positioning system used in typical elevator systems for monitoring and/or detecting a position of an elevator car within an elevator shaft. For example, the position reference system 314 can include optical position sensors, roller and/or encoder position sensors, vane position sensors, etc. as will be appreciated by those of skill in the art. During a braking operation, the health monitoring element 306 of the safety brake health monitoring system 300 will record operational data, such as duration of a braking event (obtained from one or more electronic safety actuators 308), activation of electronic brake elements (obtained from one or more electronic safety actuators 308), activation of mechanical brake elements (obtained from one or more electronic safety actuators 308), distance traveled during a braking event (obtained from one or more position reference systems 314), number of braking events, etc.

In operation, the position reference system 314 supplies elevator car position and travel information to the health monitoring element 306. Further, the electronic safety actuator 308 can supply braking information to the health monitoring element 306. The braking information can include activation of an electronic brake element of the electronic safety actuator 308, activation of a mechanical brake element of the safety brake 310, operation or actuation of the link 312, or other information associated with the first safety brake assembly 302. Similar information can be supplied to the health monitoring element 306 from the second safety brake assembly 304.

The health monitoring element 306 is also configured with preset information to enable comparison between recorded information (e.g., from the position reference systems 314 and/or from the electronic safety actuator 308). The health monitoring element 306 will compare the recorded information and compare such information against the preset information to determine if the first safety brake assembly 302 and/or the second safety brake assembly 304 should be inspected and/or maintenance should be performed thereon. Further, the health monitoring element 306 can collect data itself. For example, the health monitoring element 306 can monitor triggering/activation counts.

As noted, the health monitoring element 306 includes processing, memory, and other electronic elements to perform health monitoring functions, as described herein. The processor can sum collected or recorded information/data and compare it to present information (e.g., thresholds) and when a sum of any one or more of the recorded information/data is reached, the health monitoring element 306 can trigger a notification process to indicate that an inspection and/or maintenance procedure should be performed.

Figure 4:
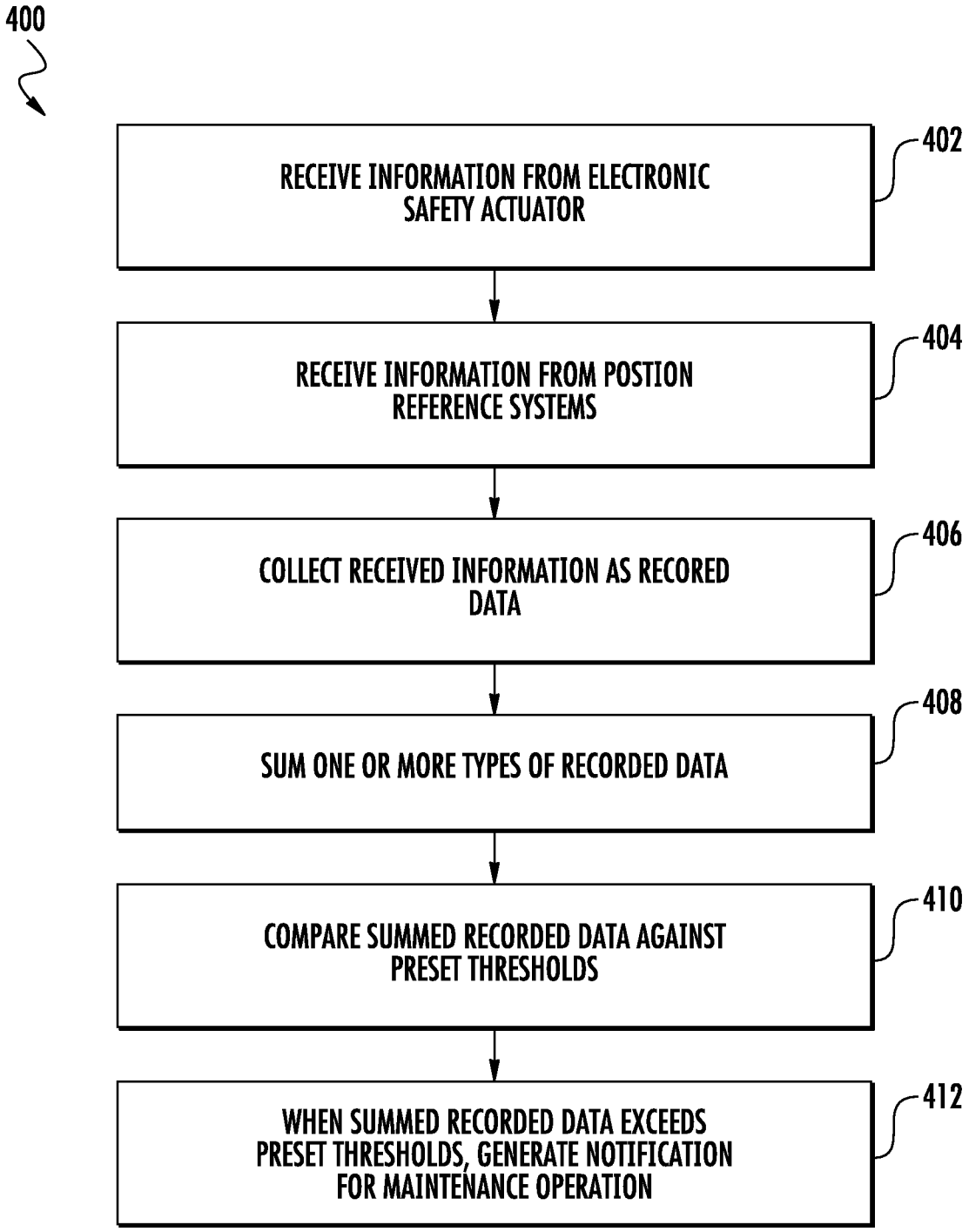
FIG. 4 is safety brake and/or safety actuator health monitoring flow process in accordance with an embodiment of the present disclosure.

Turning now to FIG. 4, a safety brake health monitoring flow process 400 is shown. The safety brake health monitoring flow process 400 can be employed by a health monitoring element or other electronic device/element that is part of and/or in communication with one or more brake assemblies having electronic safety actuators.

At block 402, a health monitoring element receives information from an electronic safety actuator. The information received from the electronic safety actuator can include activation of an electronic brake element, activation of a mechanical brake element, actuation of a link element, duration of activation of any of the elements, etc.

At block 404, the health monitoring element receives information from a position reference system. The information received from the position reference system can include position and/or travel information or data associated with a braking event (e.g., an activation operation of a safety brake assembly of an elevator system).

At block 406, the health monitoring element can convert the received information/data to recorded data. The conversion of the received information/data into recorded data may involve recording information into a storage media, such as memory, as will be appreciated by those of skill in the art. In some embodiments, the recording conversion of block 406 can occur simultaneously with the receiving of the information at blocks 402, 404. Thus, in some embodiments, the recording step (block 406) may not be a separate or distinct process step.

At block 408, the health monitoring element will sum the recorded data. The summation may be performed using a processing unit or microprocessor. The summed data may be categorized based on the source of received data, categorized based on the specific event or action that the information represents, and/or may be otherwise categorized in any manner to enable health monitoring of a safety brake assembly.

At block 410, the health monitoring element compares the summed data against one or more preset thresholds. The preset thresholds may be set for each of the categories of summed data. The preset thresholds may be preset based on laboratory testing data, simulation data, empirical data collected from other similar elevator units and/or other similar safety brake systems. The preset thresholds may be values that indicate that the safety brake is approaching end of life due to use or operation (e.g., wear and fatigue due to use). For example, a preset threshold may be a predetermined amount of time when a component of the safety brake is engaged and in contact with a guide rail, with the predetermined amount of time representing a level of wear on the component that may be indicated as requiring inspection, repair, and/or replacement. Another preset threshold may be a number of times the safety brake assembly is activated, and thus may be a count of activation. Another preset threshold may be a distance traveled with a component of the safety brake engaged with a guide rail. These are merely examples of various thresholds that may be monitored to determine a health status of a safety brake.

At block 412, if one or more of the thresholds is exceeded, the health monitoring element is configured to generate a notification that a maintenance operation should be performed on the safety brake assembly. For example, maintenance operations can include, but are not limited to, manual inspection, repair, and/or replacement. The notification can be as simple as turning on a light or other indicator within the elevator car to indicate that maintenance should be performed or a diagnostic should be performed to determine the source of the notification. In other embodiments, the notification can be an alarm or alert that provides audible, visual, or other indication that maintenance is required. Further still, in some embodiments, the notification can be a message that is transmitted from the health monitoring element (or a connected elevator controller) to a maintenance facility or other remote location. In some embodiments, the specific notification can be associated with the specific threshold that is exceeded, such that certain thresholds may indicate an inspection is required and thus an inspection notification is generated/transmitted, and a different notification can be generated/transmitted if a critical threshold is exceeded, such as requiring repair or replacement.

Advantageously, embodiments provided herein are directed to elevator safety brake systems that incorporate self-health monitoring functionality. That is, advantageously, embodiments provided herein enable onboard or in operation monitoring of a health status of a safety brake and enable automatic generation of notifications that maintenance may be required on the safety brake. Advantageously, embodiments provided herein can minimize or eliminate regularly scheduled maintenance operations performed by mechanics, thus minimizing out-of-service times of elevator systems and further reducing risks associated with mechanics being located within elevator shafts to perform the maintenance operations.

Embodiments provided herein can have various configurations without departing from the scope of the present disclosure. For example, the health monitoring logic can be performed at one or more locations associated with an elevator system, including remote therefrom. In some embodiments, the safety logic and processing elements (e.g., a printed circuit board) are separate from the safety actuators, which are in turn separate from the safety brakes. In some such embodiments, the printed circuit board can perform the health monitoring, which can be performed using an electronic safety actuator processor.

In some embodiments, the health processing and safety operations can be controlled by on-board processors that are installed inside housings of the actuators. Further, in some embodiments, speed sensor processing (e.g., position monitoring) could also be embedded within an on-board system. Thus, in some embodiments, the position monitoring of the present disclosure (e.g., distance of travel) is not required to be obtained from an external position reference system.

In accordance with embodiments of the present disclosure, an electronic safety actuator device is arranged to send messages to a safety system and/or a control system of an elevator system, in order to trigger maintenance operations (e.g., service, maintenance, repair, stop states, etc.).

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator safety brake and/or safety actuator health monitoring system comprising:

an elevator car moveable within an elevator shaft along a guide rail;

a first safety brake assembly arranged on the elevator car and configured to engage with the guide rail to provide emergency braking to the elevator car, wherein the first brake assembly includes:

a first safety brake; and an electronic safety actuator operably connected to the first safety brake; and a health monitoring element in communication with the electronic safety actuator, wherein the health monitoring element is configured to:

record information associated with operation of the first safety brake assembly;

compare the recorded information against at least one predetermined threshold; and when the recorded information exceeds the at least one predetermined threshold, generate a notification that maintenance is required, wherein the information associated with the first safety brake assembly comprises at least one of a number of times the first safety brake engages with the guide rail, an amount of time the first safety brake engages with the guide rail, an amount of time of activation of the electronic safety actuator, or a distance traveled by the first safety brake when engaged with the guide rail.

2. The health monitoring system of claim 1, further comprising a second safety brake assembly, the health monitoring element being in communication with the second safety brake assembly, wherein the health monitoring element is configured to record information associated with operation of the second safety brake assembly.

3. The health monitoring system of claim 1, further comprising a position reference system configured to detect at least one of a position of the elevator car within the elevator shaft and an amount of travel distance of the elevator car within the elevator shaft.

4. The health monitoring system of claim 1, wherein the first safety brake of the first safety brake assembly comprises one or more mechanical brake elements arranged to engage with the guide rail.

5. The health monitoring system of claim 1, wherein the electronic safety actuator comprises an electronic brake element arranged to activate the first safety brake.

6. The health monitoring system of claim 1, wherein the health monitoring element is an integral component of an elevator controller.

7. The health monitoring system of claim 1, wherein the health monitoring element is a component mounted to an exterior of the elevator car.

8. The health monitoring system of claim 1, wherein the health monitoring element is an integral component of the electronic safety actuator.

9. The health monitoring system of claim 1, wherein the notification is at least one of an alert, an alarm, and a transmitted message.

10. A method of monitoring a health of a safety brake and/or safety actuator assembly of an elevator system, the method comprising:

receiving information from an electronic safety actuator of a safety brake assembly of the elevator system at a health monitoring element;

comparing, using the health monitoring element, the received information against at least one preset threshold; and when the received information exceeds the at least one preset threshold, generating a notification that maintenance is required to be performed on the safety brake assembly, wherein the information associated with the safety brake assembly comprises at least one of a number of times the safety brake assembly engages with a guide rail, an amount of time the safety brake assembly engages with the guide rail, an amount of time of activation of the electronic safety actuator, or a distance traveled by the safety brake assembly when engaged with the guide rail.

11. The method of claim 10, further comprising summing the received information to generate recorded data, wherein the recorded data is compared against the at least one preset threshold.

12. The method of claim 10, wherein the notification is at least one of an alert, an alarm, and a transmitted message.

13. The method of claim 10, further comprising receiving at least one of position and travel information at the health monitoring element from a position reference system.

14. The method of claim 10, further comprising a second safety brake assembly, the health monitoring element being in communication with the second safety brake assembly, the method further comprising recording information associated with operation of the second safety brake assembly.

15. The method of claim 10, further comprising detecting at least one of a position of the elevator car within the elevator shaft or an amount of travel distance of the elevator car within the elevator shaft with a position reference system.

16. The method of claim 10, wherein the safety brake assembly comprises one or more mechanical brake elements arranged to engage with the guide rail.

17. The method of claim 10, wherein the electronic safety actuator comprises an electronic brake element arranged to activate the first safety brake.

18. The method of claim 10, wherein the health monitoring element is one of (i) an integral component of an elevator controller, (ii) a component mounted to an exterior of the elevator car, or (iii) an integral component of the electronic safety actuator.

* * * * *